United States Patent [19]

Commanday

[11] Patent Number: 4,976,235

[45] Date of Patent: Dec. 11, 1990

[54] APPARATUS AND METHOD TO CONTROL EXTRACTION OF LUBRICATING OIL

[76] Inventor: Maurice R. Commanday, 1401 Via Gabriel, Palos Verdes Estates, Calif. 90274

[21] Appl. No.: 431,987

[22] Filed: Nov. 6, 1989

[51] Int. Cl.[5] ..... F01M 1/00

[52] U.S. Cl. ..... 123/196 R; 184/103.1; 184/1.5; 184/105.1

[58] Field of Search ..... 123/196 R, 196 S; 184/103.1, 85, 107, 106, 108, 6.4, 6.5, 1.5

[56] References Cited

U.S. PATENT DOCUMENTS

| | | | |
|---|---|---|---|
| 526,025 | 9/1894 | Dashiell | 184/85 |
| 1,972,962 | 9/1934 | Weber | 184/103.1 |
| 2,946,405 | 7/1960 | Zachrisson | 184/103.1 |
| 3,385,109 | 5/1968 | Crane | 123/196 R |
| 4,480,718 | 11/1984 | Marinelli | 184/103.1 |

FOREIGN PATENT DOCUMENTS

| | | | |
|---|---|---|---|
| 1965609 | 7/1971 | Fed. Rep. of Germany | 184/6.4 |
| 2017917 | 10/1979 | United Kingdom | 184/103.1 |

*Primary Examiner*—E. Rollins Cross
*Attorney, Agent, or Firm*—William W. Haefliger

[57] ABSTRACT

An apparatus for extracting lubricating oil from an engine crankcase sump via an oil level dipstick tube associated with the engine and extending to near the bottom of the sump, comprising an oil extraction tube extending downwardly in the dipstick tube for extracting oil from the sump; means sealing off between the extraction tube and the dipstick tube; a sealed container having an inlet port in communication with the extraction tube for flowing extracted oil into the container and having an outlet port above the level of oil in the container; and a vacuum-producing device having an intake port in communication with the outlet port for withdrawing air from the sealed container, creating partial vacuum conditions effective to induce flow of oil into the container; the extraction tube between the dipstick tube and the container being flexible and exposed to indicate vibration as oil mixed with air is passed to the container during the extraction of final amounts of oil from the sump, and to cease vibration when oil flow to the container ceases.

13 Claims, 1 Drawing Sheet

APPARATUS AND METHOD TO CONTROL EXTRACTION OF LUBRICATING OIL

BACKGROUND OF THE INVENTION

This invention relates generally to crankcase oil extraction, and more particularly, to apparatus and method to efficiently and cleanly remove oil from a crankcase sump, as for example via the crankcase dipstick tube.

Internal combustion engines require periodic extraction and replacement of used lubricating oil in order to ensure that the quality of lubrication be maintained and unaffected by the accumulation of unfilterable particulate matter or by the breakdown of corrosion inhibitors and/or other undesirable lubricant changes that occur during use. Diesel engines, in particular, require more frequent oil changes (every 3000 miles in the case of some Mercedes-Benz diesels) than do Otto Cycle (gasoline fueled) engines due to the gradual accumulation in the diesel lubricant of fine particulate carbon which, if left to accumulate, can create a tar of sufficient viscosity as to impede the flow of lubricant with disastrous results. Further, the accumulation of particulate matter in a diesel engine lubricant renders it a very powerful staining agent capable of ruining clothing, upholstery, etc., when it is accidentally spilled. Draining diesel engine crankcases is therefore an onerous, awkward and unsanitary task, not readily accomplished by the average automobile or boat owner. Purchasing this service from others is costly, often inconvenient and sometimes improperly performed.

There is need for a simple, convenient, safe, and sanitary method and apparatus for extracting crankcase oil, which can be used reliably by any adult with minimum instruction and which will not spill any of the extracted oil when used with ordinary care.

SUMMARY OF THE INVENTION

It is a major object of the invention to provide simple, effective and easily used apparatus providing the above need, as well as method of use of such apparatus.

Basically, the apparatus of the invention is adapted for extracting lubricating (crankcase) oil from an engine crankcase sump, via a oil level dipstick tube associated with the engine. That tube is designed for extraction of the crankcase liquid contents by virtue of its lower end reaching nearly to the bottom of the oil sump (as in the case of Mercedes-Benz vehicles produced from 1977 onward). The apparatus comprises:

(a) an oil extraction tube extending downwardly in the dipstick tube for extracting oil from the sump, (b) means sealing off between the extraction tube and the dipstick tube, (c) a sealed container having an inlet port in communication with the extraction tube, for flowing extracted oil into the container, and having an inlet port above the level of oil in the container, and (d) a vacuum pumping device having an intake port in communication with the outlet port for withdrawing air from the sealed container, creating partial vacuum conditions effective to induce flow of oil into the container, (e) the extraction tube between the dipstick tube and the container being sufficiently flexible and exposed to visibly or tactily indicate vibrations as oil mixed with air is passed into the container during the extraction of final amounts of oil from the sump, and to cease vibration when oil flow to the container ceases.

As will appear, the means sealing off between the extraction and dipstick tubes may comprise first fitting, and a second fitting is usable for sealing off between the container and the extraction tube; an additional tubing extends between the outlet port and the pumping device intake port. The fittings may be understood to include hoses or tubing surfaces, as will appear.

Further, the container typically has a volume below the inlet and outlet ports which is sufficient to receive all oil from the sump.

The operation of the apparatus after, ascertaining that the container is empty, and after removing the dipstick and connecting the extraction tube into the dipstick tube, includes the steps:

(f) operating the pump to effect vacuum-induced withdrawal of oil from the sump via the extraction tube, and into the container, (g) ascertaining vibration of the extraction tube, indicating that mixed oil and air are flowing to the container, (h) observing cessation of the vibration indicating that all or substantially all the oil in the sump has been removed, and (i) then terminating the operation of the pumping device.

These and other objects and advantages of the invention, as well as the details of an illustrative embodiment, will be more fully understood from the following specification and drawings, in which:

DRAWING DESCRIPTION

FIG. 1 is an elevation showing apparatus, and its use, according to the invention.

DETAILED DESCRIPTION

Figure 1:
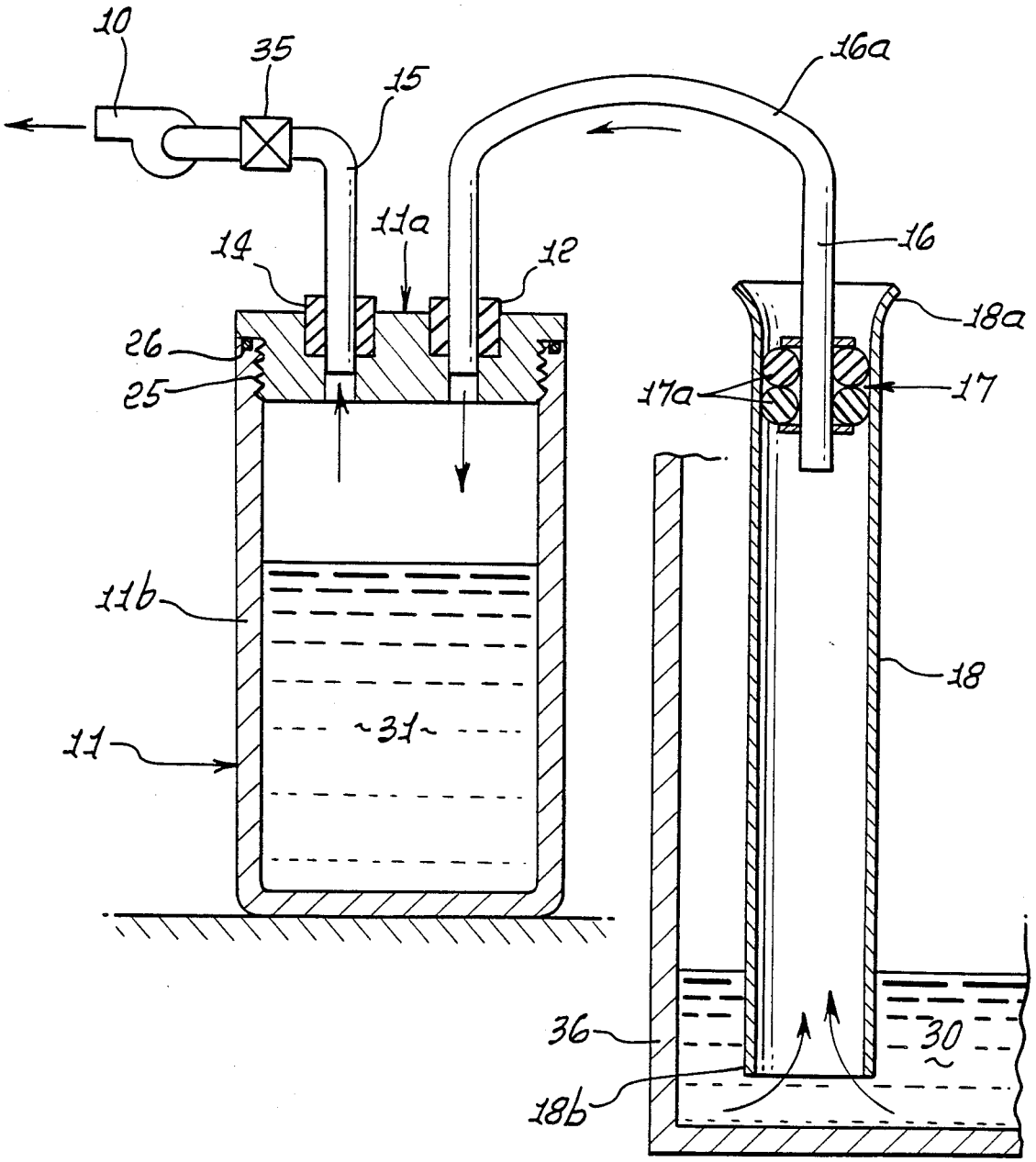

As will be seen from FIG. 1, the pumping device consists of an ejector or vacuum pump 10 of sufficient capacity, and evacuable sealed container 11 having sufficient capacity to hold the volume of extracted oil plus additional volume to assure that oil will not be accidentally drawn into the vacuum pump. Also provided are a means for opening and resealing the container to dispose of the extracted oil, a hose or pipe fitting 12 to provide access for the extracted oil to enter the container via a hose or pipe, a hose or pipe fitting 14 through which the air can be withdrawn by the device 10 in order to greatly reduce the pressure in the container to below approximately 5 inches (of mercury) below atmospheric; hoses or pipes 15 and 16 sufficient to connect the device 10 to the container and to provide access from the container to the crankcase or other oil source, and an extraction fitting 17 or other means of connecting the extraction hose to the oil source.

Typically, in the case of, but not limited to, Mercedes automotive diesel oil engines of manufacture date from approximately 1977 onwards, in which the oil dipstick tube 18 is designed for access to the contents of the crankcase inasmuch as it is of relatively large bore (10 mm, i.e., 0.394" diameter) and is further equipped with a cylindrical flared upper end **18*a* about 15 mm diameter by 30 mm in length. The dipstick tube 18 in these engines also extends to within a few thousandths of an inch from the bottom of the oil sump, as at 18*b***.

In practice, (with the vehicle on level ground and preferably with the lubricating oil at normal operating temperature) the extraction hose 16 leading to the container is connected into the end of the dipstick tube from which the dipstick has been removed. For this purpose, the extraction hose is equipped with the fitting 17 of diameter and length that enables it to enter the flared end of the dipstick tube, sealing against the inside diameter of the flare with a series of O-ring seals 17*a*. At this point, the device 10 is put into service and a partial vacuum is produced within the container 11 which causes the oil to be drawn up the dipstick tube and into the sealed container until virtually all of the oil in the crankcase has been extracted. See oil at 30 and 31.

Provided that the device 10 is of sufficient capacity for a period of time just prior to the point at which the extraction is completed, the exposed extent 16*a* of the flexible hose connecting the container to the dipstick is seen or felt to vibrate due to the flowing contents of the hose being mixed with air entering the system as the last of the oil is being withdrawn. Suddenly the vibration ceases indicating that the extraction is complete. Thus, it can be readily ascertained that all the available oil has been withdrawn. Indeed, if the crankcase drain plug is removed at this time, normally no oil at all will drain out. See crankcase 36.

Further, since this is a vacuum system, any leaks tend to flow into rather than out of the closed system so that soiling from used lubricant is easy to avoid. If further sanitation is desired after extraction is completed, dipping the end of the extraction fitting briefly into a few ounces of suitable solvent with the device 10 in operation rapidly cleans the extraction line and fitting leaving nothing to drip, not even clean solvent.

Finally, the container is sealed for transportation to a reclamation point or used oil storage point at which the extracted oil can be easily discharged quite simply with minimum risk of spillage. See container cover (first portion) 11*a* is sealingly connected (by threading and seals 25 and 26) to the container lower (reserve) portion 11*b*, these portions being separable to allow pour out of the extracted oil. A float check valve 35 may be installed in line 15 to prevent oil flow into the device 10, in the event the container is inadvertently overfilled. Seals 25 and 26 may comprise O-rings. Points of entry to the crankcase sump, other than dipstick tube, may be employed, as equivalents.

EXAMPLE 1

A Gast 440 series carbon vane vacuum pump is coupled to a ½ HP 1755 motor. Total free air displacement 4 cfm; max. vacuum 25 inches Hg. The inlet to the pump is connected by means of a flexible hose to the tank which is a modified 2½ gallon gasoline container. The inlet hose to the container (more appropriately the extraction hose) is plugged into the dipstick tube of a Mercedes 240-D crankcase and sump assembly.

EXAMPLE 2

The pump is mounted on the tank and is a GAST MOA series diaphragm pump of free air displacement about 0.5 cfm.; max. vacuum about 24 inches Hg. The pump is connected to the tank via a one inch PVC hose which incorporates a hollow plastic ball to serve as a check valve protecting the pump against the incursion of oil should the device be improperly allowed to overfill. A carrying handle may be provided. Total weight is about seven or eight pounds empty.

EXAMPLE 3

Same as EXAMPLE 2 except that an ejector is used at 10. It may comprise a common garden hose-type ejector operated in response to pressurized water flow through the ejector, whereby cost of the apparatus is minimized.

I claim:

1. Apparatus of the character described for extracting lubricating oil from an engine crankcase sump via an oil level dipstick tube associated with the engine, and extending to near the bottom of the sump, comprising, in combination with the sump and dipstick tube, (a) an oil extraction tube extending downwardly in said dipstick tube for extracting oil from the sump, the extraction tube having a lower open end proximate the bottom of the sump, (b) means sealing off between the extraction tube and the dipstick tube proximate the upper end of the dipstick tube, (c) a sealed container having an inlet port in communication with said extraction tube for flowing extracted oil into the container, and having an outlet port above the level of oil in the container, and (d) a vacuum-producing ejector device having an intake port in communication with said outlet port for withdrawing air from the sealed container, creating partial vacuum conditions effective to induce flow of oil via the extraction tube into the container, said ejector located outside the container, (e) said extraction tube between the dipstick tube and the container being flexible and exposed to visibly vibrate as oil mixed with air is passed to the container during the extraction of final amounts of oil from the sump, and to cease vibration when oil flow to the container ceases.

2. The combination of claim 1 including a second fitting for sealing off between the container and the extraction tube.

3. The combination of claim 1 including an additional tubing extending between said outlet port and said device port, and an additional fitting sealing off between the additional tubing and the container.

4. The combination of claim 2 including an additional tubing extending between said outlet port and said pump intake port, and an additional fitting sealing off between the additional tubing and the container.

5. The combination of claim 1 wherein said container has a volume below said inlet and outlet ports which is sufficient to receive all the oil from the sump.

6. The combination of claim 1 wherein the container includes a first portion into which the oil is receivable, and a second portion removably attached to said first portion, said second portion defining said inlet and outlet ports.

7. The combination of claim 1 wherein the dipstick tube has a lower end that extends downwardly into the sump, proximate to the bottom of the sump, and the extraction tube lower open end is below the level of the dipstick tube lower open end.

8. The method of claim 1 wherein the lower open end of the extraction tube is maintained below the bottom level of the dipstick tube in the sump during operation of said device.

9. The combination of claim 1 including a check valve connected in series between said container and said vacuum-producing device.

10. The method of operating apparatus for extracting lubricating oil from an engine crankcase sump via an oil level dipstick tube associated with the engine, and extending to near the bottom of the sump, comprising (a) an oil extraction tube extending downwardly in said dipstick tube for extracting oil from the sump, the extraction tube having a lower open end proximate the bottom of the sump, (b) means sealing off between the extraction tube and the dipstick tube, (c) a sealed container having an inlet port in communication with said extraction tube for flowing extracted oil into the container, and having an outlet port above the level of oil in the container, and (d) a vacuum-producing ejector device having an intake port in communication with said outlet port for withdrawing air from the sealed container, creating partial vacuum conditions effective to induce flow of oil into the container.

(e) said extraction tube between the dipstick tube and the container being flexible and exposed to visibly vibrate as oil mixed with air is passed to the container during the extraction of final amounts of oil from the sump, and to cease vibration when oil flow to the container ceases, which includes:

(f) operating said device to effect vacuum-induced withdrawal of oil from a level proximate the lowermost level of oil in the sump via said extraction tube, and into the container, (g) allowing and ascertaining vibration of the extraction tube outside and above the dipstick tube, indicating that mixed oil and air are flowing to the container, (h) observing cessation of said vibration indicating that all or substantially all the oil in the sump has been removed, and (i) then terminating said operation of the device.

11. The method of claim 10 wherein the container includes a first portion into which the oil is receivable, and a second portion removably attached to said first portion, said second portion defining said inlet and outlet ports and including the step (j) then separating said first and second portions, and removing the oil from the container.

12. The method of claim 10 wherein said device is operated as an ejector and produces vacuum.

13. Apparatus of the character described for extracting lubricating oil from an engine crankcase sump via an oil access tube associated with the engine comprising, in combination with the sump and access tube, (a) an oil extraction tube extending downwardly in said access tube for extracting oil from the sump, the extraction tube having a lower open end proximate the bottom of the sump, (b) means sealing off between the extraction tube and the access tube proximate the upper end of the access tube, (c) a vacuum-producing ejector device having an intake port in communication with said extraction tube for creating partial vacuum conditions effective to induce flow of oil via the extraction tube to the exterior of the crankcase, said ejector located outside the crankcase, (d) said extraction tube being flexible and exposed to visibly vibrate as oil mixed with air is passed via said tube during the extraction of final amounts of oil from the sump, and to cease vibration when oil flow ceases.

* * * * *